US011089842B2

(12) United States Patent
Millward et al.

(10) Patent No.: US 11,089,842 B2
(45) Date of Patent: Aug. 17, 2021

(54) BUCKLE WITH WHISTLE

(71) Applicant: ILLINOIS TOOL WORKS INC., Glenview, IL (US)

(72) Inventors: Eric W. Millward, Evanston, IL (US); John S. Pontaoe, Chicago, IL (US); Thomas A. Moeller, Reno, NV (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/706,260

(22) Filed: Dec. 6, 2019

(65) Prior Publication Data

US 2021/0169180 A1 Jun. 10, 2021

(51) Int. Cl.

| | |
|---|---|
| ***A44B 11/00*** | (2006.01) |
| ***A44B 11/26*** | (2006.01) |
| ***G10K 5/00*** | (2006.01) |

(52) U.S. Cl.

CPC ..... *A44B 11/005* (2013.01); *A44B 11/266* (2013.01); *G10K 5/00* (2013.01)

(58) Field of Classification Search

CPC ..... G01K 5/00; G01K 5/02; A44B 11/005; A44B 11/266

See application file for complete search history.

(56) References Cited

U.S. PATENT DOCUMENTS

| | | | | |
|---|---|---|---|---|
| 5,546,887 | A * | 8/1996 | Cameron | G10K 5/00 116/137 R |
| 6,668,428 | B2 * | 12/2003 | Moeller | A44B 11/001 24/163 R |
| 7,581,509 | B2 * | 9/2009 | Eventoff | G10K 5/00 116/137 R |
| 8,776,713 | B2 * | 7/2014 | Shishido | G10K 5/00 116/137 R |
| D743,289 | S * | 11/2015 | Mundhra | D10/119.3 |
| 2003/0116078 | A1 * | 6/2003 | Topman | G10K 5/00 116/137 R |
| 2005/0237736 | A1 * | 10/2005 | Wimsatt | A44B 15/005 362/196 |
| 2010/0115736 | A1 * | 5/2010 | Paik | G10K 5/00 24/163 R |

* cited by examiner

*Primary Examiner* — Robert Sandy
(74) *Attorney, Agent, or Firm* — Quarles & Brady LLP

(57) ABSTRACT

An example buckle assembly includes a body and a latch. The body includes an integral whistle portion. The latch is configured to snapably mate with the body.

17 Claims, 11 Drawing Sheets

BUCKLE WITH WHISTLE

FIELD OF THE DISCLOSURE

Embodiments of the present disclosure generally relate to a fastening system, and, more particularly, to a buckle that is configured to securely connect multiple components together and includes a whistle.

BACKGROUND

In recent years, buckles have been developed to fasten straps to one another. For example, luggage (e.g., backpacks, duffel bags, suitcases, etc.) include various straps releasably connected to one another to close the luggage, adjust the luggage to a user, adjust the luggage to an item being carried, etc.

Certain known buckles include a whistle for the user to signal information (e.g., a location, an upcoming turn, directions, etc.) to another party. When the user blows into the whistle, the whistle produces a whistling sound.

However, these known buckles include a body and a plug. The plug fits into the body to define a whistle cavity. These plugs have high insertion forces and are thus often difficult for operators to install the known fasteners. Improper installation of the plugs may lead to loss of the plug, without which the buckle cannot produce the whistling sound.

Therefore, a need exists for a buckle that is ergonomic for operators to assemble and that remains securely assembled.

SUMMARY

In one aspect, an example buckle assembly is disclosed that includes a body and a latch. The body includes an integral whistle portion. The latch is configured to snapably mate with the body.

In another aspect, an example buckle body is disclosed that includes a guiding portion and a whistle portion. The whistle portion is integrally connected to the guiding portion. The whistle portion defines a whistle cavity.

In a further aspect, an example buckle latch is disclosed that includes a locking portion and a whistle portion. The whistle portion is integrally connected to the locking portion. The whistle portion defines a whistle cavity.

Figure 1:
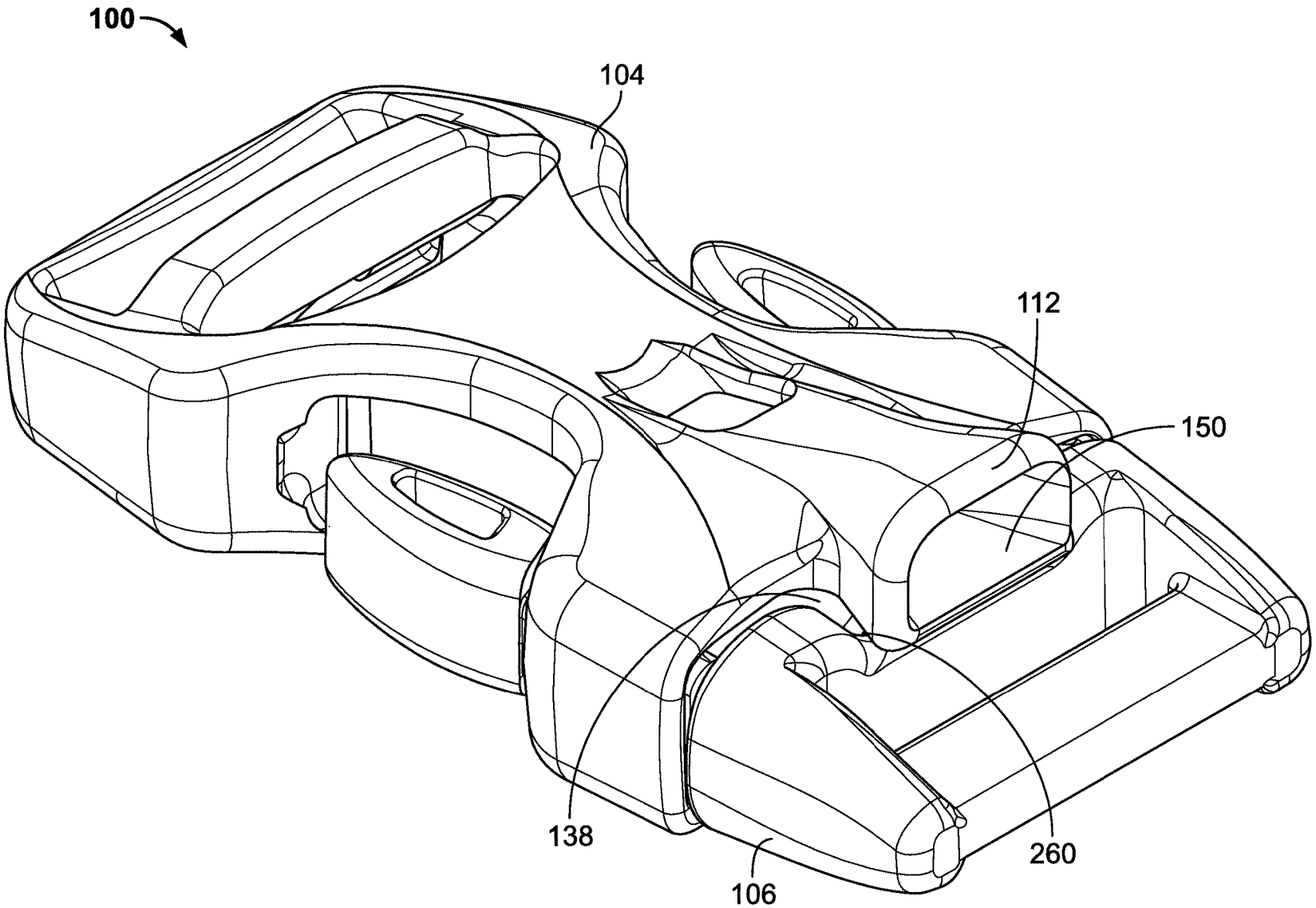
FIG. 1 is an isometric view of a first example buckle assembly according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

Embodiments of the present disclosure provide a buckle assembly with features that facilitate operators in assembling the buckle assembly and facilitate users in producing a whistling sound with a whistle formed in the buckle assembly.

A first example buckle assembly 100 according to an embodiment of the present disclosure is depicted in FIGS. 1, 2, 14, and 15. The buckle assembly 100 includes a body 104 and a latch 106. In some embodiments, the structures of the body 104 are integrally connected to one another. In other words, in some embodiments, the body 104 is unitary. The latch 106 snapably locks in the body 104. The latch 106 is configured to releasably mate with the body 104 in multiple orientations. In other words, the latch 106 is symmetrically arranged to be flippably mateable with the body 104.

Figure 3:
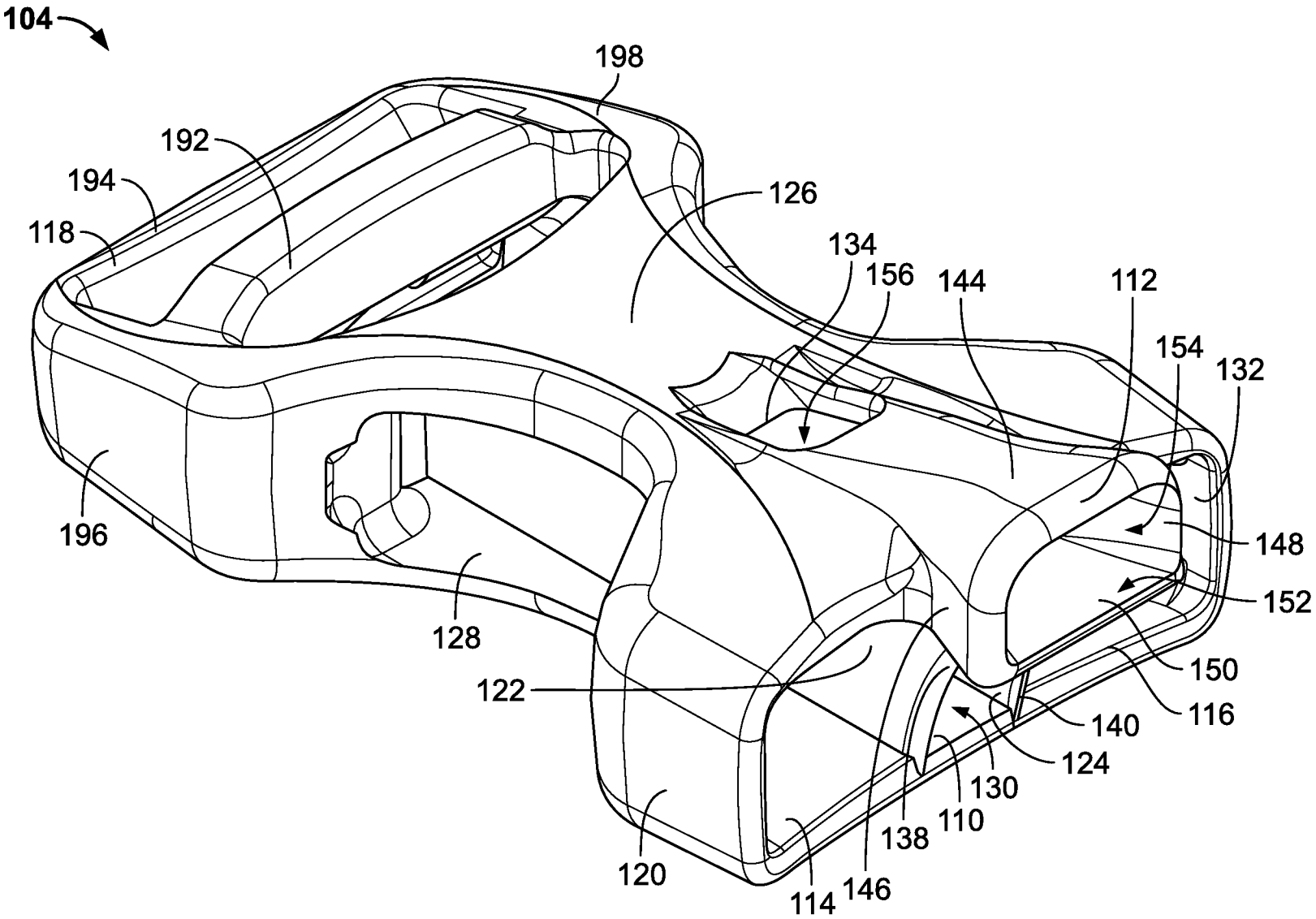
FIG. 3 is an isometric view of a body of the first example buckle assembly of FIGS. 1 and 2.

With reference to FIG. 3, the body 104 includes a guiding portion 110, a whistle portion 112, a first locking wing 114, a second locking wing 116, and a strap adjuster 118. The whistle portion 112 is connected to and between the first locking wing 114 and the second locking wing 116. The strap adjuster 118 extends from the whistle portion 112. In some embodiments, the body 104 is formed from a single shot of material (e.g., injection-molded plastic). Thus, in some embodiments, the body 104 is unitary and integrally formed.

With reference to FIG. 3, the whistle portion 112 includes a first inner wall 122, a second inner wall 124, a top wall 126, and a bottom wall 128. The first inner wall 122 is connected to and between the top wall 126 and the bottom wall 128. The second inner wall 124 is connected to and between the top wall 126 and the bottom wall 128. The first inner wall 122, the second inner wall 124, the top wall 126, and the bottom wall 128 define a guide cavity 130.

With reference to FIG. 3, in some embodiments, the body 104 is formed from multiple shots of material (e.g., injection-molded plastic and/or rubber). Thus, in some embodiments, the body 104 is unitary and integrally formed while the guiding portion 110, the whistle portion 112, the first locking wing 114, the second locking wing 116, and the strap adjuster 118 are respectively formed of one or more materials. For example, in some embodiments, the whistle portion 112 may be formed of a first material (e.g., a soft-touch elastomer, a glow-in-the dark plastic polymer, a flexible polymer, etc.) and the guiding portion 110, the first locking wing 114, the second locking wing 116, and the strap adjuster 118 may be formed of a second material (e.g., a rigid plastic polymer). In some embodiments, the guiding portion 110, the whistle portion 112, the first locking wing 114, the second locking wing 116, and the strap adjuster 118 are respectively formed in one or more colors of a like material.

With reference to FIG. 3, in some embodiments, the whistle portion 112 is hingedly connected to the guiding portion 110 via a living hinge (not shown). In some embodiments, the whistle portion 112 is metallic and one or more of the guiding portion 110, the first locking wing 114, the second locking wing 116, and the strap adjuster 118 are non-metallic (e.g., polymer plastic). Thus, in some embodiments, the whistle portion 112 is a separate structure relative to the guiding portion 110, the first locking wing 114, the second locking wing 116, and the strap adjuster 118 are non-metallic. Further, in some embodiments, the whistle portion 112 is connected to the guiding portion 110 (e.g., adhesively, snapably, via interference fit, etc.).

With reference to FIG. 3 the top wall 126 is shaped to include a sounding edge 134. When a user blows into the whistle portion 112, air is diverted at the sounding edge 134 to produce a whistling sound, as will be explained in greater detail below.

Figure 8:
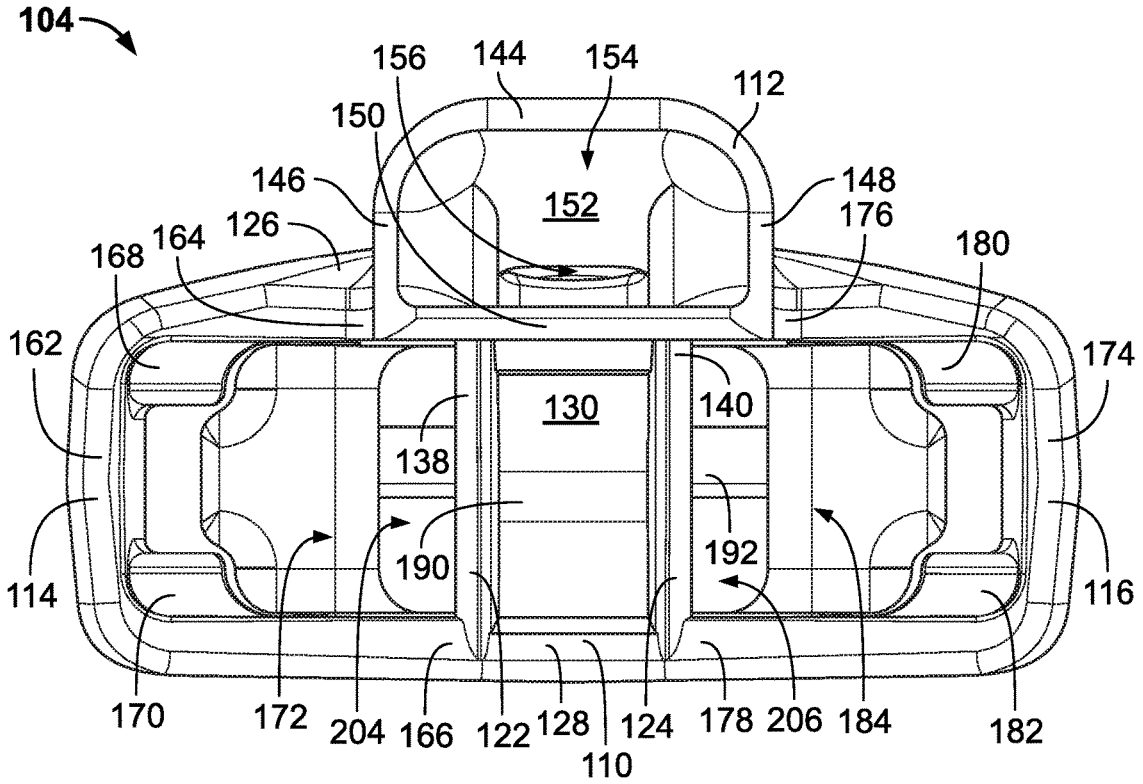
FIG. 8 is another end view of the body of FIGS. 3-7.

With reference to FIG. 8, whistle portion 112 further includes a first support rib 138, a second support rib 140, a first ramp wall 144, a second ramp wall 146, a third ramp wall 148, and a lower wall 150. The second ramp wall 146 is between and connected to the first ramp wall 144 and the lower wall 150. The third ramp wall 148 is between and connected to the first ramp wall 144 and the lower wall 150. The first support rib 138 and the second support rib 140 further define the guide cavity 130. The first ramp wall 144, the second ramp wall 146, the third ramp wall 148, and the lower wall 150 define a whistle cavity 152. The second ramp wall 146 and the third ramp wall 148 are non-parallel. The first ramp wall 144 and the lower wall 150 are also non-parallel. Thus, the whistle cavity 152 is pyramidal in shape.

Figure 10:
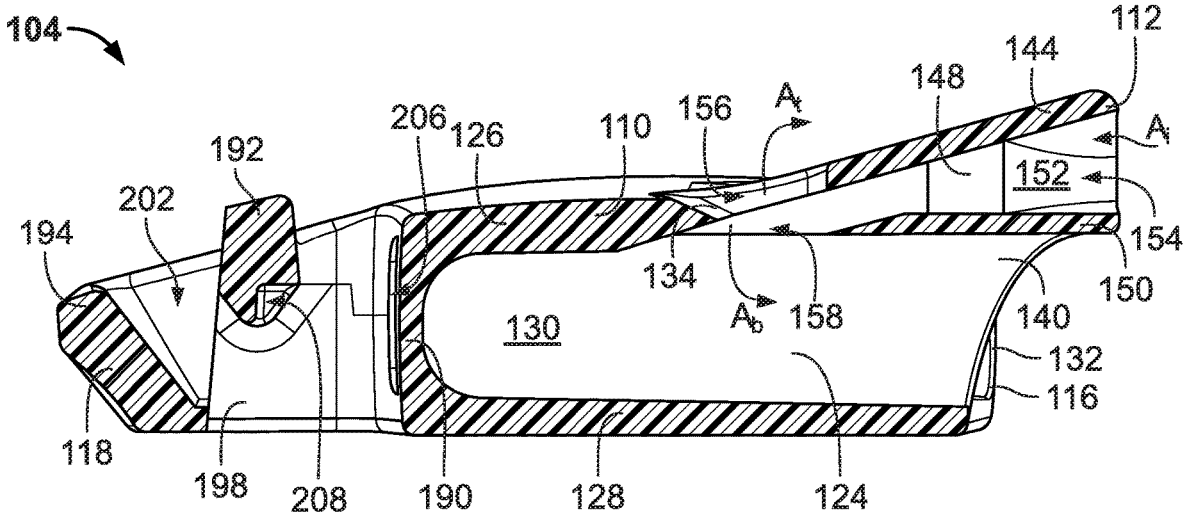
FIG. 10 is a cross-sectional view of the body of FIGS. 3-9 taken along line 10-10 of FIG. 5.

With reference to FIG. 10, the first ramp wall 144, the second ramp wall 146, the third ramp wall 148, and the lower wall 150 also define an inlet 154. The inlet 154 is in fluid communication with the whistle cavity 152. Additionally, the lower wall 150 extends from the top wall 126.

Figure 9:
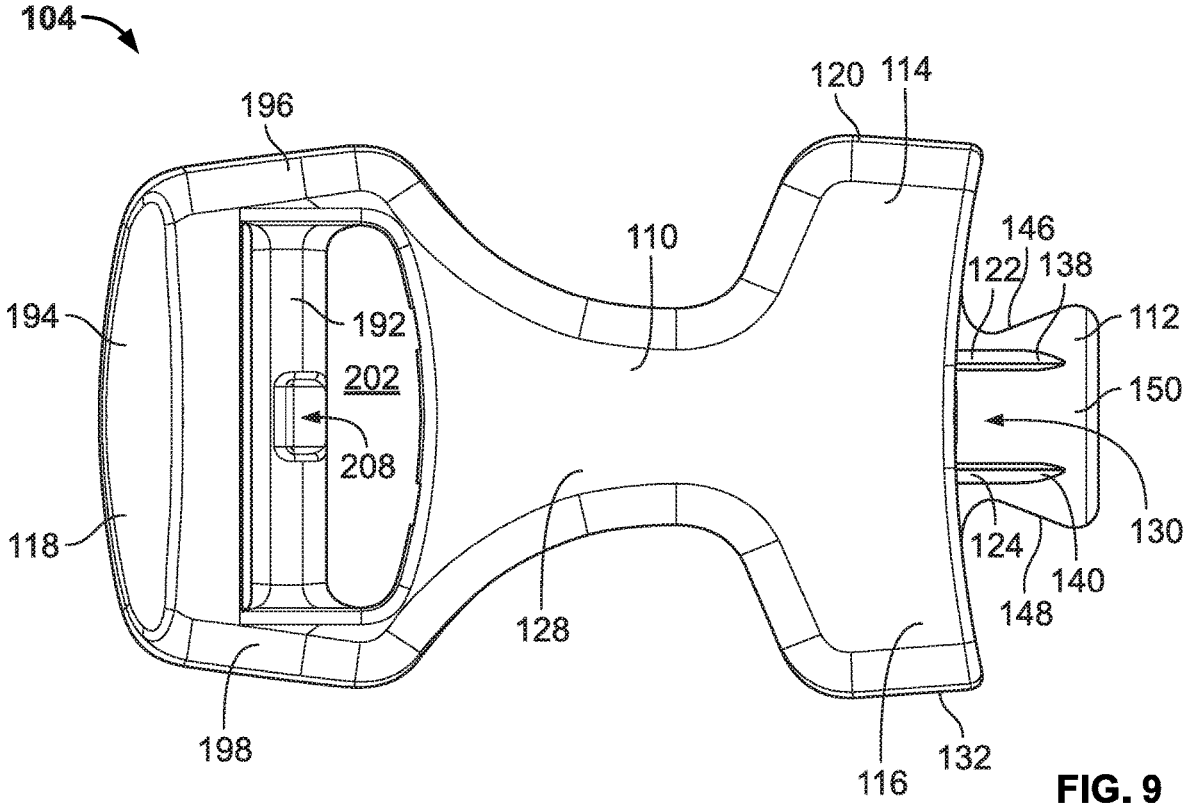
FIG. 9 is a bottom view of the body of FIGS. 3-8.

With reference to FIG. 9, the first support rib 138 extends from the first inner wall 122. The second support rib 140 extends from the second inner wall 124. The first support rib 138 and the second support rib 140 support the lower wall 150. In operation, the first support rib 138 and the second support rib 140 work to form a seal with a user's lower lip as the user blows into the whistle cavity 152 via the inlet 154 (shown in FIG. 10).

Figure 5:
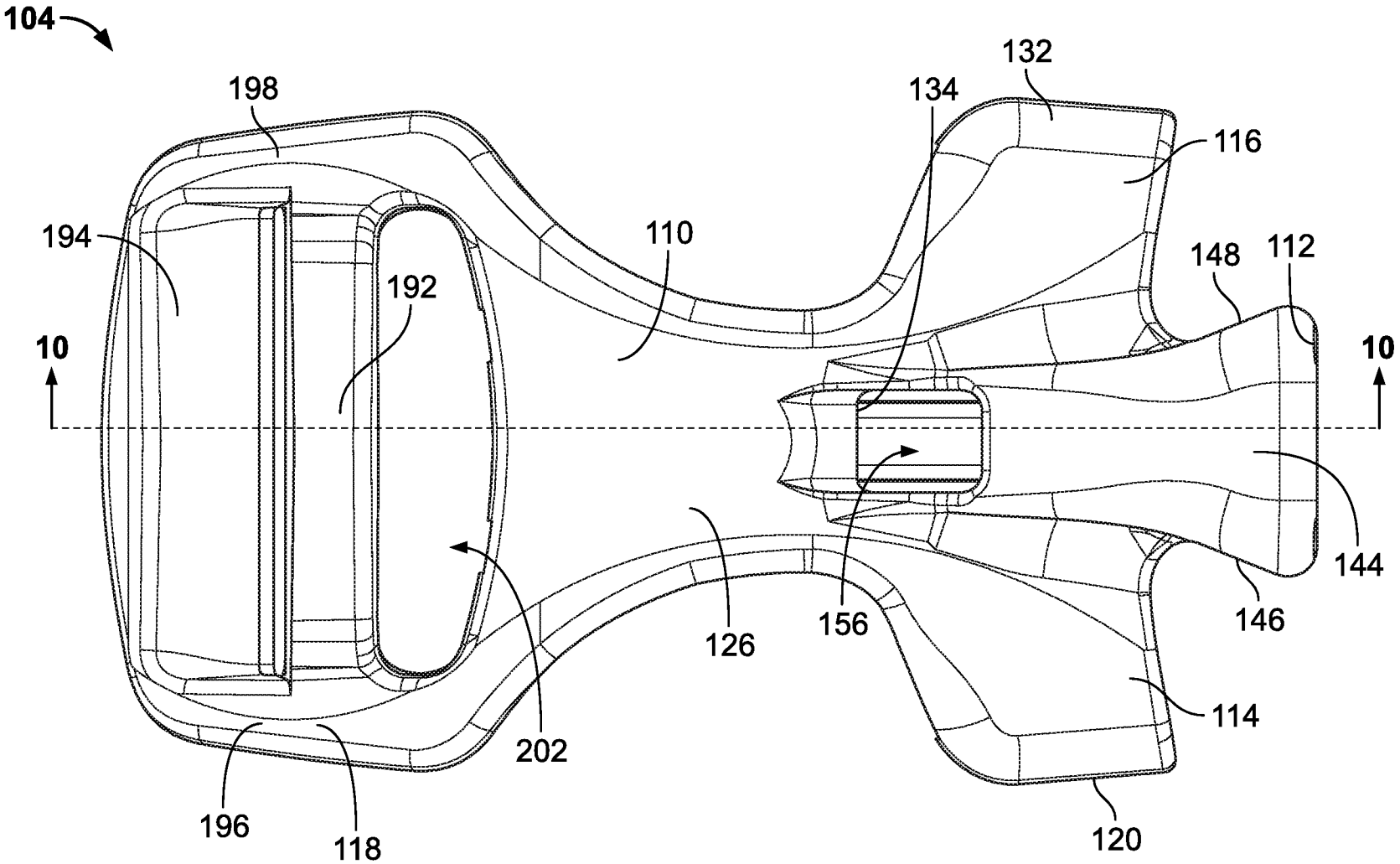
FIG. 5 is a top view of the body of FIGS. 3 and 4.
Figure 6:
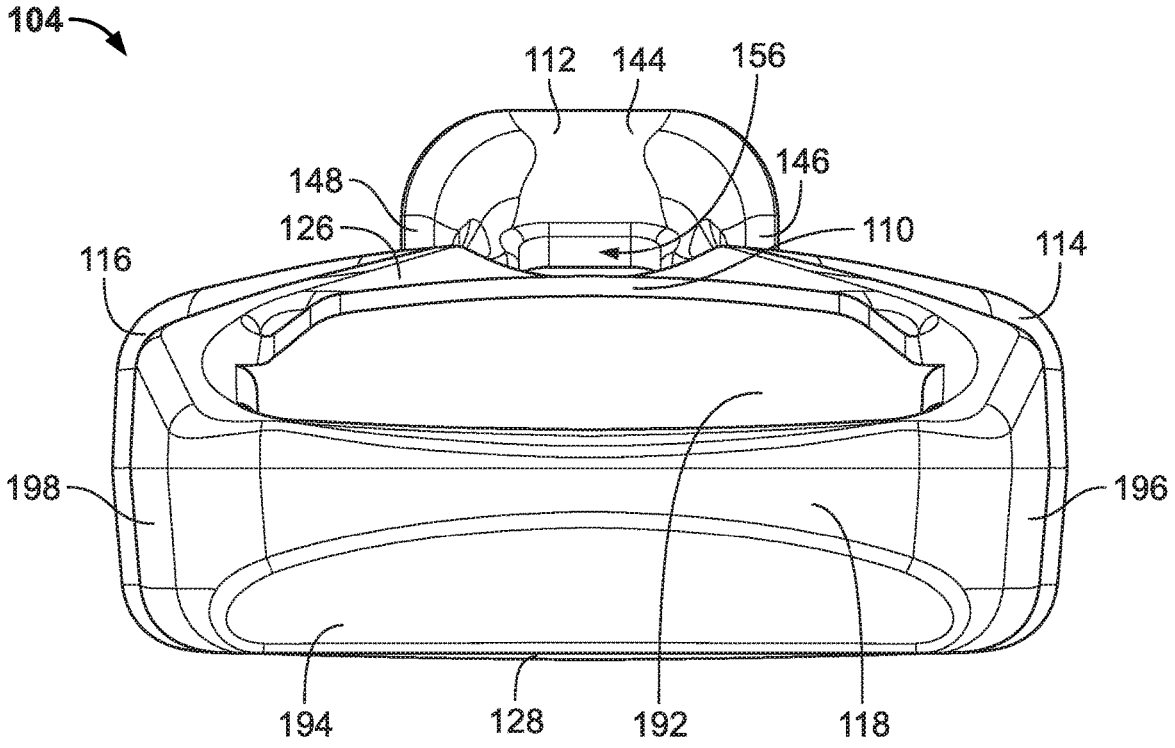
FIG. 6 is an end view of the body of FIGS. 3-5.
Figure 7:
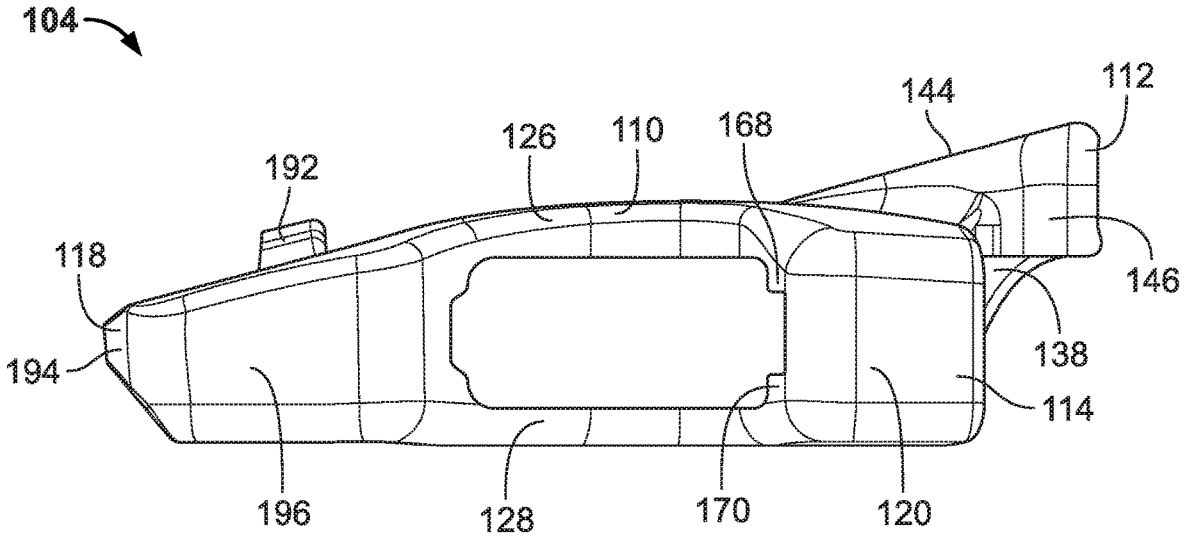
FIG. 7 is a side view of the body of FIGS. 3-6.

With reference to FIG. 5, first ramp wall 144, the second ramp wall 146, the third ramp wall 148, and the top wall 126 define a first outlet 156. Thus, the sounding edge 134 partially defines the first outlet 156. Because the first ramp wall 144 is ramped relative to the lower wall 150 and the second ramp wall 146 is ramped relative to the third ramp wall 148, the whistle cavity 152 narrows from the inlet 154 to the first outlet 156.

With reference to FIG. 10, the second ramp wall 146 (shown in FIG. 8), the third ramp wall 148, and the lower wall 150 define a second outlet 158. The sounding edge 134 further defines the second outlet 158. The second outlet 158 is opposite the first outlet 156. The whistle cavity 152, the first outlet 156, and the second outlet 158 are in fluid communication with one another.

With reference again to FIG. 10, in operation, a user positions an upper lip (not shown) on the first ramp wall 144. The user further positions a lower lip (not shown) on the lower wall 150, the first support rib 138, and the second support rib 140. The first support rib 138 and the second support rib 140 are contoured for the user's comfort against the user's lower lip. The upper lip sealingly engages the first ramp wall 144, the second ramp wall 146, the third ramp wall 148, and the lower lip. Further, the lower lip sealingly engages the first support rib 138, the lower wall 150, the second support rib 140, and the upper lip. Thus, the user's upper and lower lips sealingly engage one another and the whistle portion 112.

With reference still to FIG. 10, further in operation, a user blows a flow of air $A_i$ into the whistle cavity 152. When the flow of air $A_i$ is blown through the whistle cavity 152, the flow of air $A_i$ is sharply diverted at the sounding edge 134 into a top flow $A_t$ and a bottom flow $A_b$. The top flow $A_t$ flows upwardly out of the body 104 via the first outlet 156. The bottom flow $A_b$ flows out of the body 104 via the second outlet 158 and the guide cavity 130. When the top flow $A_t$ is diverted upwardly at the sounding edge 134, the top flow $A_t$ forms swirling vortexes of air. Because the top flow $A_t$ is whirling, the top flow $A_t$ produces vibrations in the air above the first outlet 156. Thus, the top flow $A_t$ generates sound waves. In other words, blowing the flow of air $A_i$ into the whistle cavity 152 and across the sounding edge 134 produces a whistling sound.

With reference to FIG. 8, the first locking wing 114 includes a first outer wall 162, the top wall 126, and the bottom wall 128. The first outer wall 162 is connected to and between the top wall 126 and the bottom wall 128. Put differently, the first locking wing 114 is U-shaped and includes a first upper end 164 and a first lower end 166. Thus, the first locking wing 114 connects to the whistle portion 112 at the first upper end 164 and the first lower end 166. The first locking wing 114 further includes a first upper shoulder 168 and a first lower shoulder 170. The first upper shoulder 168 extends from the top wall 126 and the first outer wall 162. The first lower shoulder 170 extends from the bottom wall 128 and the first outer wall 162. The top wall 126, the bottom wall 128, the first inner wall 122, the first outer wall 162, the first upper shoulder 168, and the first lower shoulder 170 define a first passage 172.

With reference again to FIG. 8, the second locking wing 116 includes a second outer wall 174, the top wall 126, and the bottom wall 128. The second outer wall 174 is connected to and between the top wall 126 and the bottom wall 128. Put differently, the second locking wing 116 is U-shaped and includes a second upper end 176 and a second lower end 178. Thus, the second locking wing 116 connects to the whistle portion 112 at the second upper end 176 and the second lower end 178. The second locking wing 116 further includes a second upper shoulder 180 and a second lower shoulder 182. The second upper shoulder 180 extends from the top wall 126 and the second outer wall 174. The second lower shoulder 182 extends from the bottom wall 128 and the second outer wall 174. The top wall 126, the bottom wall 128, the second inner wall 124, the second outer wall 174, the second upper shoulder 180, and the second lower shoulder 182 define a second passage 184.

Figure 4:
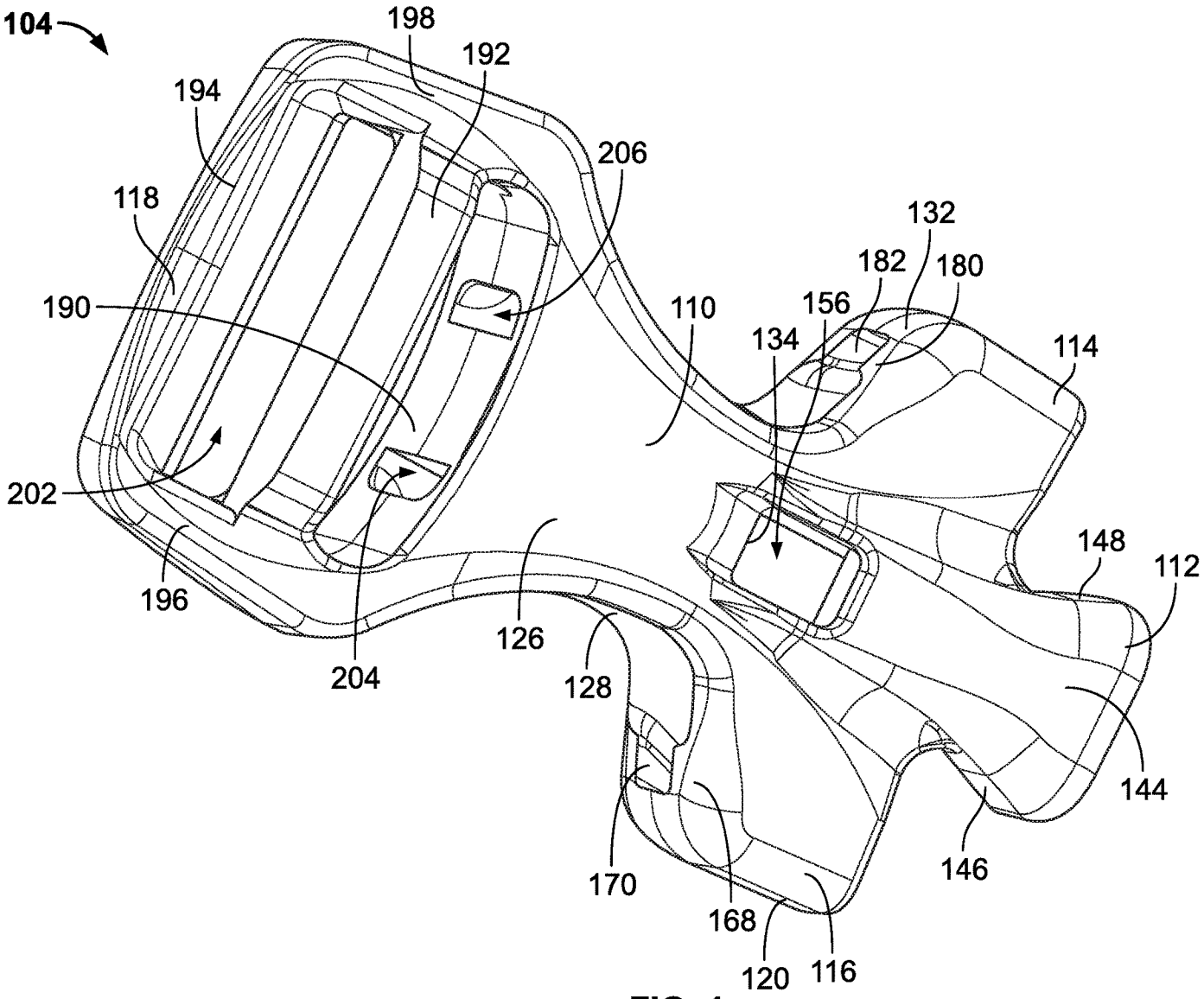
FIG. 4 is another isometric view of the body of FIG. 3.

With reference to FIG. 4, the strap adjuster 118 includes a front wall 190, a first routing bar 192, a second routing bar 194, a first connector 196, and a second connector 198. The first connector 196 and the second connector 198 extend from the front wall 190. The first routing bar 192 is connected to and between the first connector 196 and the second connector 198. The second routing bar 194 is connected to and between the first connector 196 and the second connector 198. The first routing bar 192 is between the second routing bar 194 and the front wall 190. The second routing bar 194, the first connector 196, the second connector 198, and the front wall 190 define a routing cavity 202. The front wall 190 defines a first window 204 and a second window 206.

With reference to FIG. 10, the first routing bar 192 defines a notch 208. In operation a strap (not shown) is routed through the routing cavity 202 around the first routing bar 192 to contact the notch 208 and the second routing bar 194. Frictional forces between the strap and the first routing bar 192 and additional frictional forces between the strap and the second routing bar 194 selectively hold the strap stationary relative to the strap adjuster 118. In other words, the strap is adjustably retained by the strap adjuster 118.

With reference again to FIG. 10, the front wall 190 further defines the guide cavity 130. It should be appreciated that particulates (e.g., sand, dust, dirt, etc.) and fluids (e.g., water, air, soap, etc.) may easily pass through the whistle cavity 152, the guide cavity 130, the first outlet 156, the second outlet 158, and the inlet 154. Thus, the debris may easily fall out of the whistle portion 112. Additionally, the whistle portion 112 may be easily cleaned.

Figure 11:
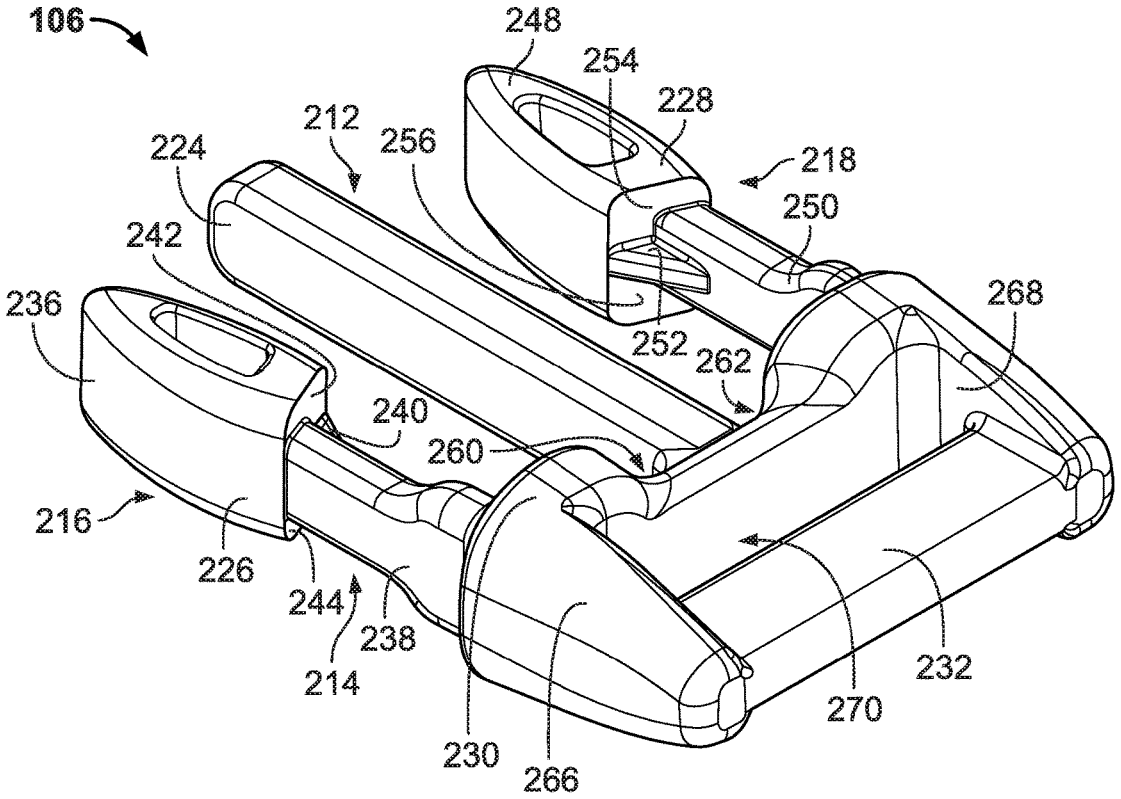
FIG. 11 is an isometric view of a latch of the first example buckle assembly of FIGS. 1 and 2.
Figure 12:
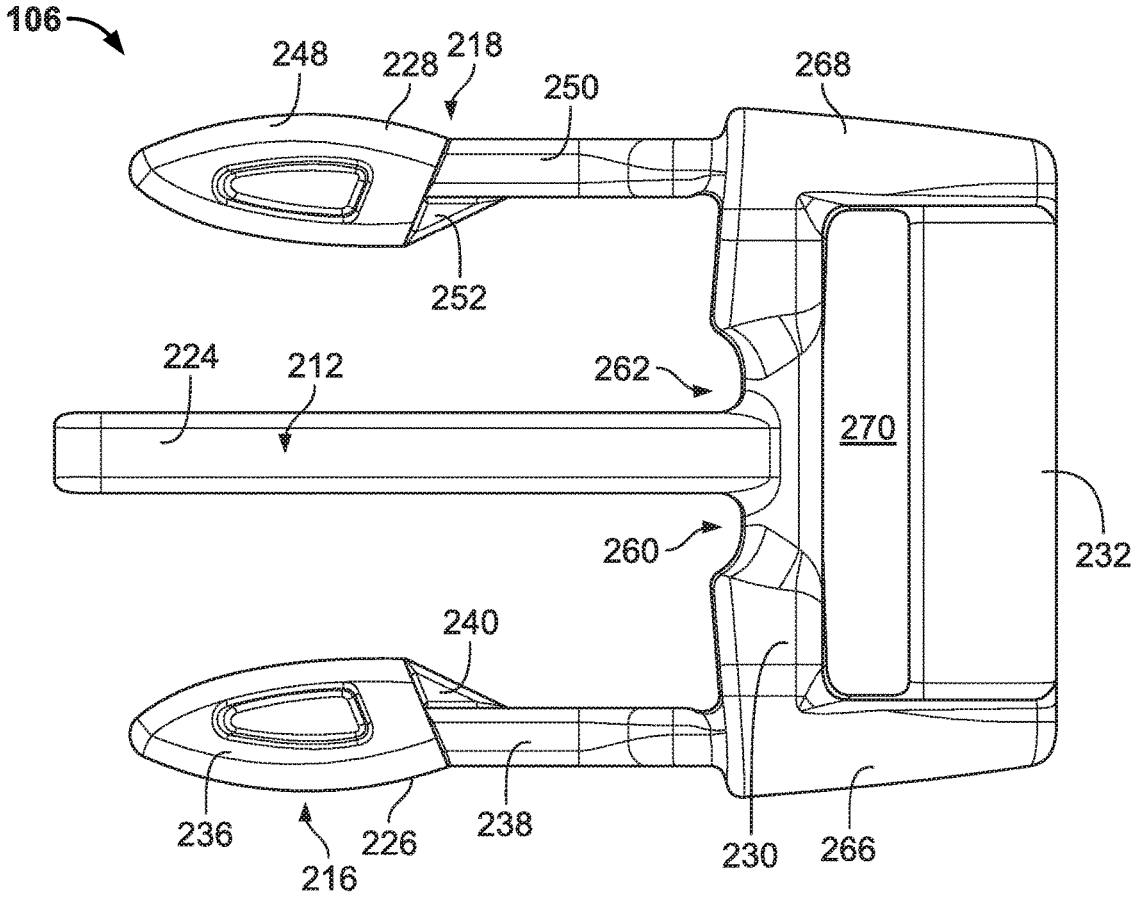
FIG. 12 is a top view of the latch of FIG. 11.
Figure 13:
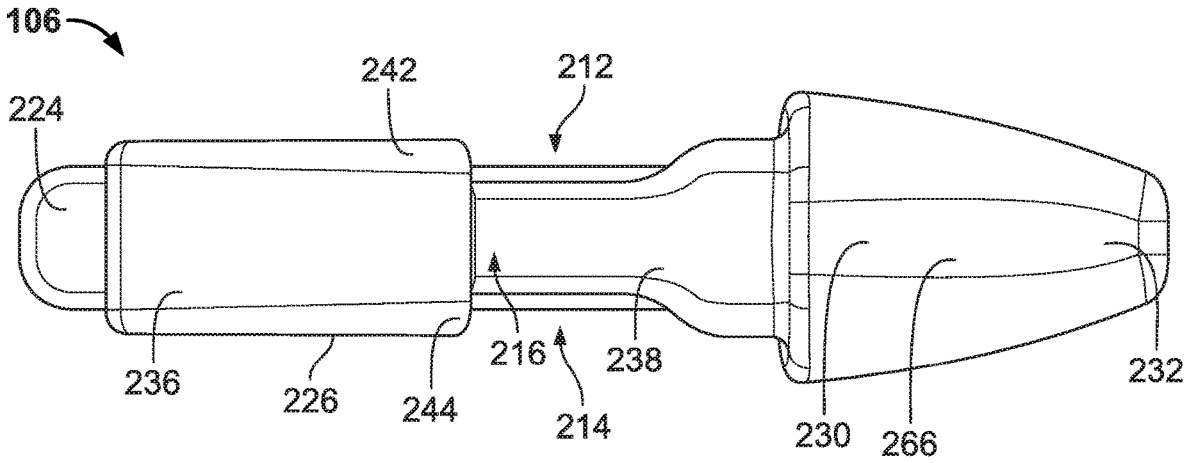
FIG. 13 is a side view of the latch of FIGS. 11 and 12.

With reference to FIG. 11, the latch 106 includes a top 212, a bottom 214, a first side 216, and a second side 218. It should be appreciated that the top 212 is a mirror image of the bottom 214, as shown in FIG. 13. It should also be appreciated that the second side 218 is a mirror image of the first side 216, as shown in FIG. 12. Thus, the latch 106 may lockably mate with the body 104 in recto and verso orientations, as shown in FIGS. 1, 2, 14, and 15. In some embodiments, the latch 106 is formed from a single shot of material (e.g., injection-molded plastic). Thus, in some embodiments, the latch 106 is unitary and integrally formed.

With reference to FIG. 11, the latch 106 further includes a guide bar 224, a first locking arm 226, a second locking arm 228, a base 230, and a strap loop 232. The guide bar 224, the first locking arm 226, and the second locking arm 228 extend from the base 230. The strap loop 232 also extends from the base 230. The strap loop 232 is opposite the guide bar 224, the first locking arm 226, and the second locking arm 228. The guide bar 224 is between the first locking arm 226 and the second locking arm 228.

With reference still to FIG. 11, the first locking arm 226 includes a first latch body 236, a first resilient portion 238, and a first rib 240. The first resilient portion 238 is connected to and between the base 230 and the first latch body 236. The first rib 240 is connected to the first latch body 236 and the first resilient portion 238. The first rib 240 reinforces the connection between the first latch body 236 and the first resilient portion 238. The first latch body 236 and the first resilient portion 238 define a first top shoulder 242 and a first bottom shoulder 244. The first latch body 236 resiliently pivots relative to the base 230 via the first resilient portion 238. In some embodiments, the first latch body 236 is bulbous.

With reference again to FIG. 11, the second locking arm 228 includes a second latch body 248, a second resilient portion 250, and a second rib 252. The second resilient portion 250 is connected to and between the base 230 and the second latch body 248. The second rib 252 is connected to the second latch body 248 and the second resilient portion 250. The second rib 252 reinforces the connection between the second latch body 248 and the second resilient portion 250. The second latch body 248 and the second resilient portion 250 define a second top shoulder 254 and a second bottom shoulder 256. The second latch body 248 resiliently pivots relative to the base 230 via the second resilient portion 250. In some embodiments, the second latch body 248 is bulbous.

With reference to FIG. 12, in some embodiments, the base 230 defines a first divot 260 and a second divot 262. The first divot 260 is between the guide bar 224 and the first locking arm 226. The second divot 262 is between the guide bar 224 and the second locking arm 228. It should be understood that the first divot 260 and the second divot 262 are optional. Thus, in some embodiments, the first divot 260 and/or the second divot 262 may be omitted.

With reference to FIG. 12, the strap loop 232 is U-shaped and includes a first end 266 and a second end 268. The strap loop 232 is connected to the base 230 at the first end 266 and the second end 268. The base 230 and the strap loop 232 define a strap window 270. In operation, a strap is routed through the strap window 270 and around the strap loop 232.

Figure 2:
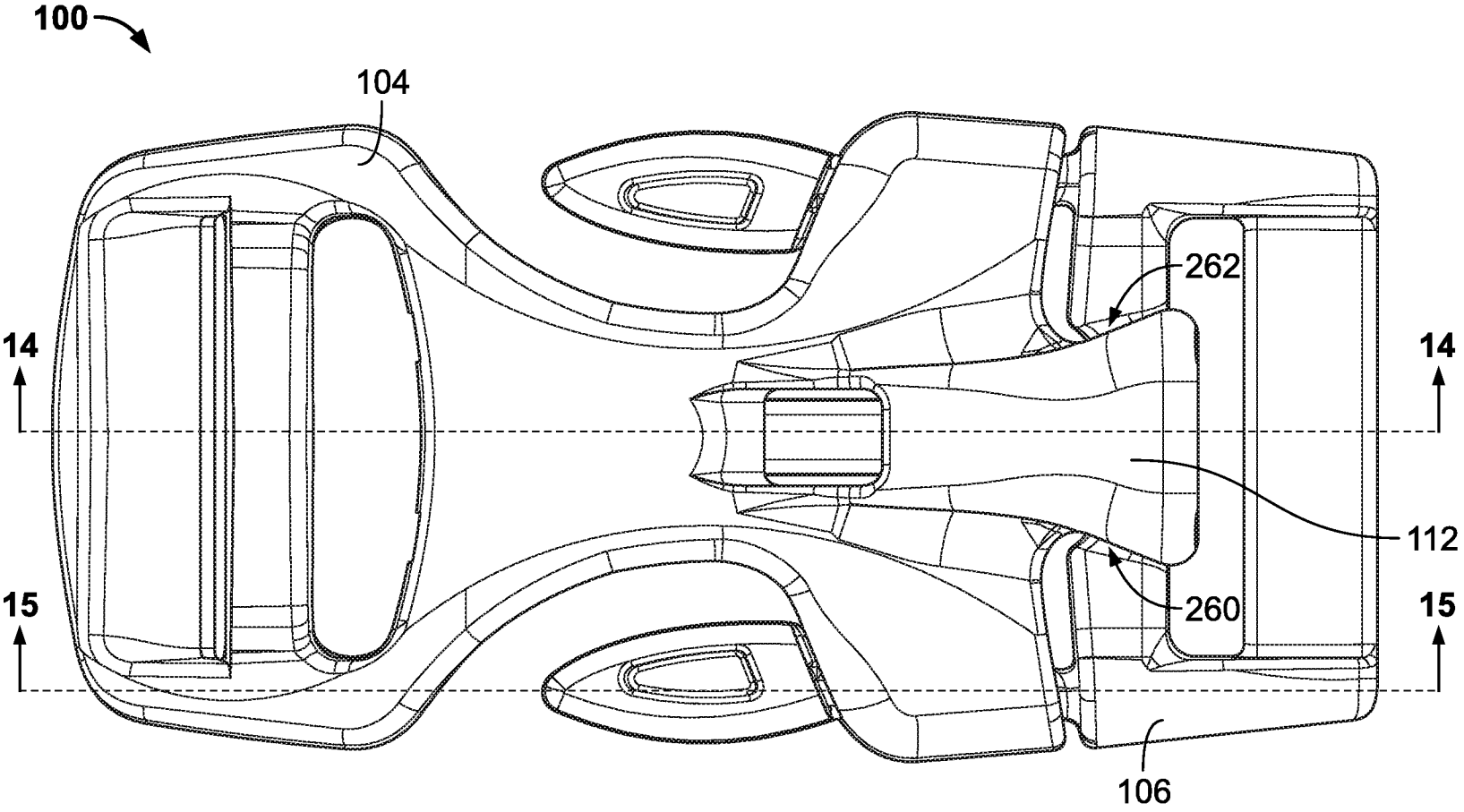
FIG. 2 is a top view of the first example buckle assembly of FIG. 1.

With reference to FIG. 2, in operation, when the latch 106 is assembled into the body 104, the first divot 260 and the second divot 262 accommodate the whistle portion 112. Additionally, with reference to FIG. 14, the guide bar 224 slidably engages the body 104 in the guide cavity 130 to align the latch 106 relative to the body 104.

Figure 14:
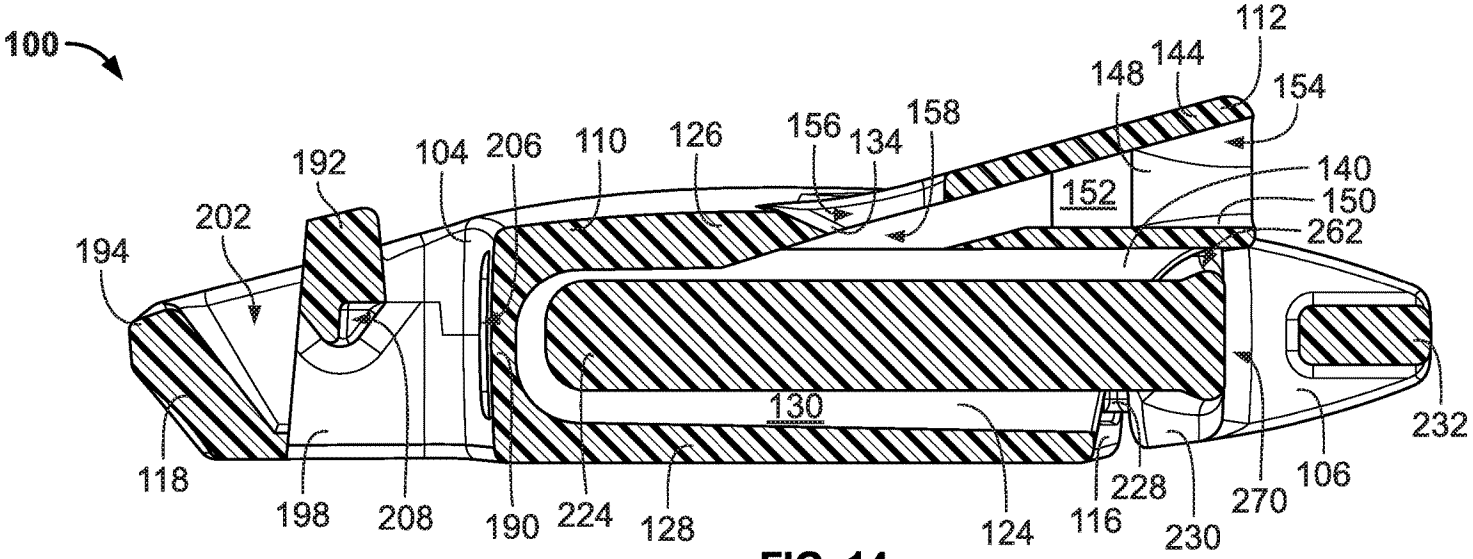
FIG. 14 is a cross-sectional view of the first example buckle assembly of FIGS. 1 and 2 taken along line 14-14 of FIG. 2.

With reference to FIG. 14, it should be appreciated that the whistle portion 112 is aligned with the latch 106. Thus, the guide cavity 130 and the whistle cavity 152 are generally parallel with the guide bar 224. Further, the sounding edge 134 is generally perpendicular with the guide bar 224.

Figure 15:
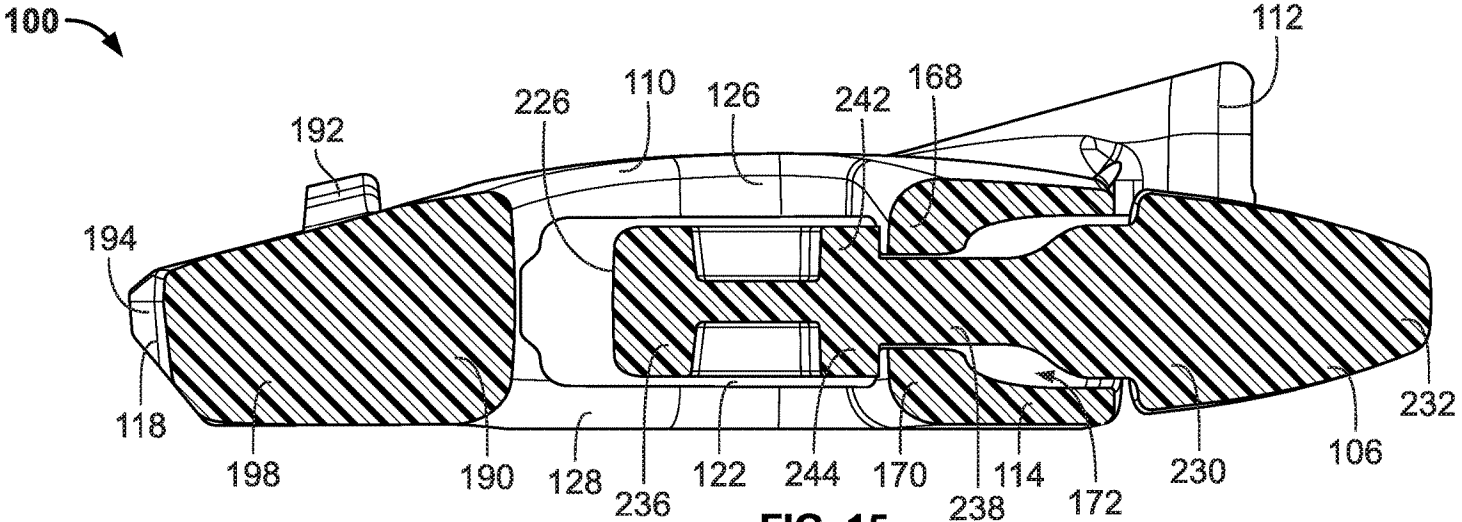
FIG. 15 is a cross-sectional view of the first example buckle assembly of FIGS. 1, 2, and 14 taken along line 15-15 of FIG. 2.

With reference to FIG. 15, in operation, when the latch 106 is being assembled into the body 104, the first latch body 236 resiliently pivots inwardly toward the first inner wall 122 via the first resilient portion 238 to pass through the first passage 172. When the first latch body 236 exits the first passage 172, the first resilient portion 238 pivotably snaps the first latch body 236 outwardly away from the first inner wall 122. Thus, the first top shoulder 242 is aligned with and engages the first upper shoulder 168. Further, the first bottom shoulder 244 is aligned with and engages the first lower shoulder 170. Additionally in operation, to release the latch 106 from the body 104, the user may squeeze the first locking arm 226 inwardly toward the first inner wall 122 to disengage the first top shoulder 242 from the first upper shoulder 168 and the first bottom shoulder 244 from the first lower shoulder 170. The second locking arm 228 passes through the second passage 184 to engage the second upper shoulder 180 and the second lower shoulder 182 in the same manner as the first locking arm 226 (not shown). The second locking arm 228 may be disengaged from the second upper shoulder 180 and the second lower shoulder 182 in the same manner as the first locking arm 226 (not shown).

Figure 16:
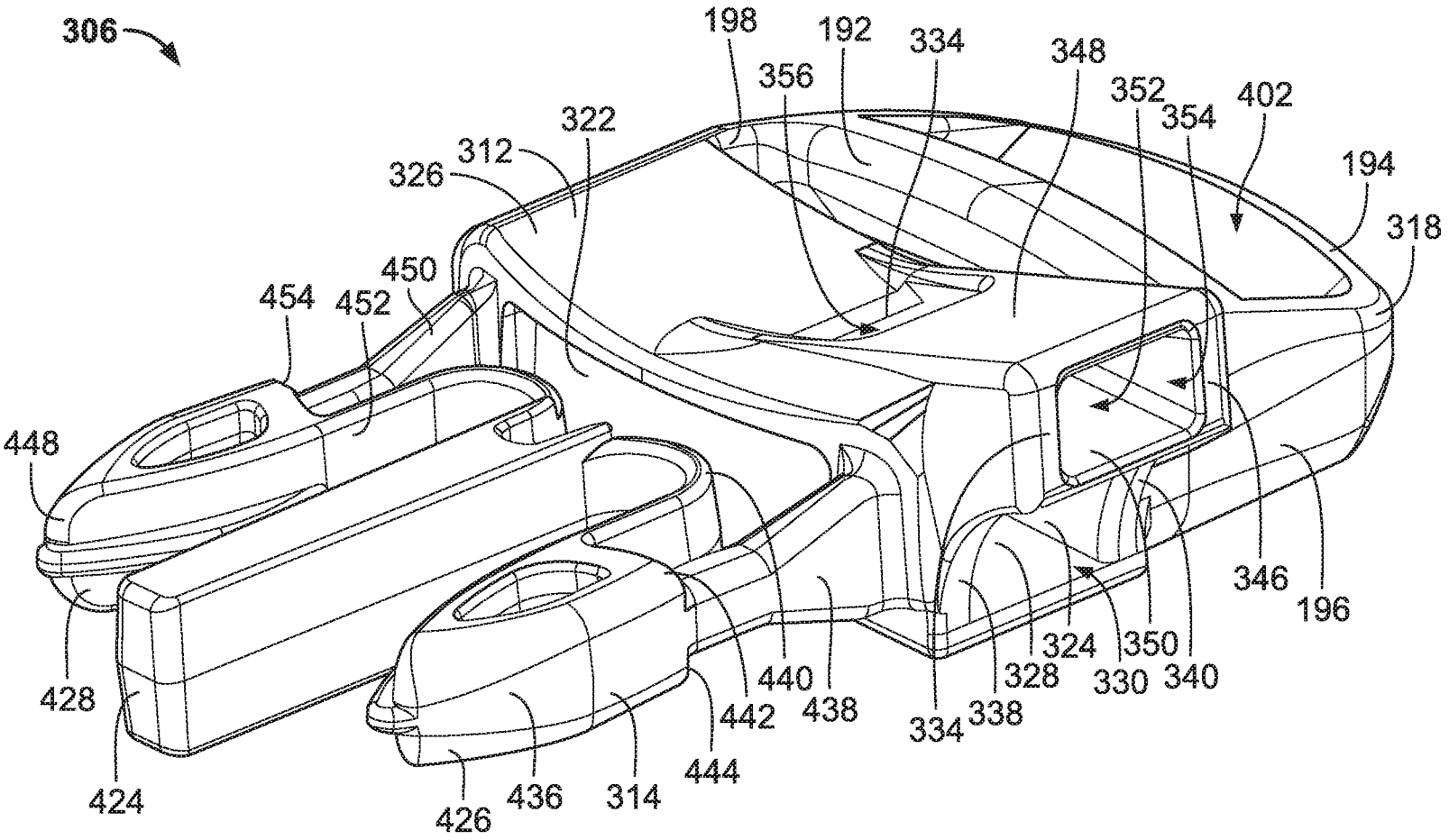
FIG. 16 is an isometric view of a second example buckle latch according to an embodiment of the present disclosure.

With reference to FIG. 16, a second example latch 306 includes a whistle portion 312, a locking portion 314, and a strap adjuster 318. The whistle portion 312 is connected to and between the locking portion 314 and the strap adjuster 318. Thus, the locking portion 314 is opposite the strap adjuster 318. In some embodiments, the whistle portion 312 is integrally connected to the locking portion 314 and the strap adjuster 318.

With reference to FIG. 16, the whistle portion 312 includes a first side wall 322, a second side wall 324, a top wall 326, and a first lower wall 328. The first side wall 322 is connected to and between the top wall 326 and the first lower wall 328. The first side wall 322 is connected to the locking portion 314. The second side wall 324 is connected to and between the top wall 326 and the first lower wall 328. The second side wall 324 is connected to the strap adjuster 318. The first side wall 322, the second side wall 324, the top wall 326, and the first lower wall 328 define a lower cavity 330.

With reference to FIG. 16, the top wall 326 is shaped to include a sounding edge 334. Additionally, the whistle portion 312 further includes a first support rib 338, a second support rib 340.

The whistle portion 312 includes a third side wall 344, a fourth side wall 346, a ramp wall 348, and a second lower wall 350. The third side wall 344 is between and connected to the ramp wall 348 and the second lower wall 350. The fourth side wall 346 is between and connected to the ramp wall 348 and the second lower wall 350. The first support rib 338 and the second support rib 340 further define the lower cavity 330. The third side wall 344, the fourth wall 346, the ramp wall 348, and the second lower wall 350 define a whistle cavity 352. The ramp wall 348 and the second lower wall 350 are non-parallel. Thus, the whistle cavity 352 is wedge-shaped.

With reference to FIG. 16, the third side wall 344, the fourth side wall 346, the ramp wall 348, and the second lower wall 350 also define an inlet 354. The inlet 354 is in fluid communication with the whistle cavity 352. Additionally, the second lower wall 350 extends from the top wall 326.

With reference to FIG. 16, the first support rib 338 extends from the first side wall 322. The second support rib 340 extends from the second side wall 324. The first support rib 338 and the second support rib 340 support the second lower wall 350. In operation, the first support rib 338 and the second support rib 340 work to form a seal with a user's lower lip as the user blows into the whistle cavity 352 via the inlet 354.

With reference to FIG. 16, the third side wall 344, the fourth side wall wall 346, the ramp wall 348, and the top wall 326 define a first outlet 356. Thus, the sounding edge 334 partially defines the first outlet 356. Because the ramp wall 348 is ramped relative to the second lower wall 350, the whistle cavity 352 narrows from the inlet 354 to the first outlet 356. Additionally, the third side wall 346, the fourth side wall 348, and the second lower wall 350 define a second outlet (not shown). The sounding edge 334 further defines the second outlet. The second outlet is opposite the first outlet 156. The whistle cavity 352, the first outlet 356, and the second outlet are in fluid communication with one another in the same manner as in the body 104, as explained above with reference to FIG. 10.

With reference again to FIG. 16, in operation, a user positions an upper lip (not shown) on the ramp wall 348. The user further positions a lower lip (not shown) on the second lower wall 350, the first support rib 338, and the second support rib 340. The first support rib 338 and the second support rib 340 are contoured for the user's comfort against the user's lower lip. The upper lip sealingly engages the ramp wall 348, the third side wall 344, the fourth side wall 346, and the lower lip. Further, the lower lip sealingly engages the first support rib 338, the second lower wall 350, the second support rib 340, and the upper lip. Thus, the user's upper and lower lips sealingly engage one another and the whistle portion 312.

With reference still to FIG. 16, further in operation, a user blows a flow of air (not shown) into the whistle cavity 352. The flow of air is sharply diverted across the sounding edge 334 to produce a whistling sound in the same manner as with the whistling portion 112, as explained above with reference to FIG. 10.

With reference to FIG. 16, the strap adjuster 318 includes the first routing bar 192, the second routing bar 194, the first connector 196, and the second connector 198. The first connector 196 and the second connector 198 extend from the second side wall 324. The first routing bar 192 is connected to and between the first connector 196 and the second connector 198. The second routing bar 194 is connected to and between the first connector 196 and the second connector 198. The first routing bar 192 is between the second routing bar 194 and the front wall 190. The second routing bar 194, the first connector 196, the second connector 198, and the second side wall 324 define a routing cavity 402.

With reference to FIG. 16, a strap (not shown) may be routed through the routing cavity 402 around the first routing bar 192 and the second routing bar 194. The strap is adjustably retained in the strap adjuster 318 in the same manner as with the strap adjuster 118, as explained above with reference to FIG. 10.

With reference again to FIG. 16, it should be appreciated that particulates (e.g., sand, dust, dirt, etc.) and fluids (e.g., water, air, soap, etc.) may easily pass through the whistle cavity 352, the lower cavity 330, the first outlet 356, the second outlet 358 (not shown), and the inlet 354. Thus, the debris may easily fall out of the whistle portion 312. Additionally, the whistle portion 312 may be easily cleaned.

With reference to FIG. 16, the locking portion 314 is shaped to lockably mate with a compatible body in recto and verso orientations. In some embodiments, the latch 306 is formed from a single shot of material (e.g., injection-molded plastic). Thus, in some embodiments, the latch 306 is unitary and integrally formed.

With reference to FIG. 16, the locking portion 314 includes a guide bar 424, a first locking arm 426, and a second locking arm 428. The first locking arm 426, and the second locking arm 428 extend from the first side wall 322. The guide bar 424 is connected to and between the first locking arm 426 and the second locking arm 428.

With reference still to FIG. 16, the first locking arm 426 includes a first latch body 436, a first resilient stem 438, and a first resilient rib 440. The first resilient stem 438 is connected to and between the first side wall 322 and the first latch body 436. The first resilient rib 440 is connected to the first latch body 236 and the first guide bar 424. The first latch body 436 and the first resilient stem 438 define a first top shoulder 442 and a first bottom shoulder 444. The first latch body 436 resiliently pivots relative to the first side wall 322 via the first resilient stem 438 and the first resilient rib 440. In some embodiments, the first latch body 436 is bulbous.

With reference again to FIG. 16, the second locking arm 428 includes a second latch body 448, a second resilient stem 450, and a second resilient rib 452. The second resilient stem 450 is connected to and between the first side wall 322 and the second latch body 448. The second resilient rib 452 is connected to the second latch body 448 and the guide bar 424. The second latch body 448 and the second resilient stem 450 define a second top shoulder 454 and a second bottom shoulder (not shown). The second latch body 448 resiliently pivots relative to the first side wall 322 via the second resilient stem 450 and the second resilient rib 452. In some embodiments, the second latch body 448 is bulbous.

With reference to FIG. 16, it should be appreciated that the whistle portion 312 is arranged transversely relative to the locking portion 314. Thus, the lower cavity 330 and the whistle cavity 352 are generally perpendicular to the guide bar 424. Further, the sounding edge 334 is generally parallel with the guide bar 424.

Embodiments of the present disclosure provide a fastening system, and, more particularly, a buckle assembly that is configured to securely connect multiple components together (e.g., straps) and be ergonomic for an operator to assemble. The buckle assembly includes a body and a latch that releasably mate with one another. The body is unitary and defines cavities to form an integrally built-in whistle. The latch has snap arms, which provide a relatively low insertion force to snapably releasably connect the latch to the body. Additionally, the latch mates with the body in multiple configurations.

From the foregoing, it will be appreciated that the above example buckle assembly 100 includes a unitary latch 106 that snapably mates with a unitary body 104 with a built-in whistle portion 112. Additionally, it will be appreciated that the above example latch 306 also has a built-in whistle portion 312 and may be unitary. Because the body 104 and the latch 106 are each unitary, the buckle assembly 100 may be easier for an operator to assemble, which may prevent assembly line stoppages, reduce scrap due to misassembly, and/or improve manufacturing efficiency. Similarly, because the latch 306 is unitary, the latch 306 obviates assembly by an operator, which may also prevent assembly line stoppages, reduce scrap due to misassembly, and/or improve manufacturing efficiency. Thus, the above-disclosed buckle assembly 100 and latch 306 conserve resources and may improve manufacturing efficiency as compared to existing fasteners.

While the whistle has been disclosed herein as being incorporated into a buckle, embodiments of the whistle may be incorporated into any fastener for tending a strap, web, or cord or into a zipper pull.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various Features of the Disclosure are Set Forth in the Following Claims.

What is claimed is:

1. A buckle assembly, comprising:
a body including an integral whistle portion; and
a latch configured to snapably mate with the body,
wherein the whistle portion includes ramp walls and a lower wall defining a whistle cavity.

2. The buckle assembly of claim 1, wherein the body is unitary.

3. The buckle assembly of claim 1, wherein the body defines the whistle cavity, a first outlet, and a second outlet to form the whistle portion.

4. The buckle assembly of claim 1, wherein the body includes a locking wing connected to the whistle portion.

5. The buckle assembly of claim 1, wherein the body includes a sounding edge to divert a flow of air blown through the whistle portion to produce a whistling sound.

6. The buckle assembly of claim 1, wherein the body defines a guide cavity to align the latch relative to the body.

7. The buckle assembly of claim 1, wherein the latch snapably mates with the body in multiple orientations.

8. The buckle assembly of claim 1, wherein the latch includes a guide bar to slidably engage the body.

9. The buckle assembly of claim 1, wherein the latch defines a divot to accommodate the whistle portion.

10. The buckle assembly of claim 1, wherein the body includes a first support rib and a second support rib connected to the whistle portion.

11. The buckle assembly of claim 1, wherein the body includes a guiding portion connected to the whistle portion to align the latch relative to the body.

12. The buckle assembly of claim 1, wherein the latch includes a locking arm to snapably engage the body.

13. The buckle assembly of claim 1, wherein the whistle cavity is pyramidal in shape.

14. The buckle assembly of claim 1, wherein the latch is unitary.

15. The buckle assembly of claim 1, wherein the body includes a strap adjuster.

16. A buckle body, comprising:
a guiding portion; and
a whistle portion integrally connected to the guiding portion and defining a whistle cavity,
wherein the guiding portion defines a guide cavity in fluid communication with the whistle cavity.

17. The buckle body of claim 16, wherein:
the whistle portion includes a sounding edge,
the sounding edge partially defines an outlet, and
the outlet is in fluid communication with the whistle cavity.

* * * * *